United States Patent [19]

Mochizuki et al.

[11] Patent Number: 4,880,768

[45] Date of Patent: Nov. 14, 1989

[54] SUBLIMATION TYPE THERMOSENSITIVE IMAGE TRANSFER RECORDING MEDIUM

[75] Inventors: Hidehiro Mochizuki, Shizuoka; Masanaga Imamura, Fujinomiya; Akira Suzuki, Mishima; Masaru Shimada, Shizuoka; Hiroyuki Uemura, Numazu, all of Japan

[73] Assignee: Ricoh Company, Ltd., Tokyo, Japan

[21] Appl. No.: 241,409

[22] Filed: Sep. 7, 1988

[30] Foreign Application Priority Data

| | | | |
|---|---|---|---|
| Sep. 7, 1987 | [JP] | Japan | 62-224268 |
| Nov. 6, 1987 | [JP] | Japan | 62-280434 |
| Mar. 15, 1988 | [JP] | Japan | 63-062866 |
| Apr. 15, 1988 | [JP] | Japan | 63-091290 |

[51] Int. Cl.[4] ..... B41M 5/035; B41M 5/26

[52] U.S. Cl. ..... 503/227; 8/471; 428/212; 428/216; 428/913; 428/914; 430/945

[58] Field of Search ..... 8/471; 428/195, 212, 428/480, 913, 914; 503/227

[56] References Cited

U.S. PATENT DOCUMENTS 3,647,503 3/1972 Mizutani et al. ..... 503/227

*Primary Examiner*—Bruce H. Hess

*Attorney, Agent, or Firm*—Oblon, Spivak, McClelland, Maier & Neustadt

[57] ABSTRACT

A sublimation type thermosensitive image transfer recording medium which can be used in repetition, comprising a support; a dye supplying layer formed on the support, comprising a sublimable dye and at least one binder agent in which the sublimable dye is dissolved or dispersed; and an image transfer facilitating layer formed on the dye supplying layer, comprising the sublimable dye and at least one organic binder agent in which the sublimable dye is dissolved or dispersed, the dye supplying layer and the image transfer facilitating layer being structured in such a manner that when the dye supplying layer and the image transfer facilitating layer are separately formed on a substrate, and the layers are separately superimposed on the same receiving sheet, with application of an equal quantity of thermal energy thereto, the amount (weight/unit time.unit area) of the sublimable dye transferred from the dye supplying layer to the receiving sheet is greater than the amount (weight/unit time.unit area) of the sublimable dye transferred from the image transfer facilitating layer to the receiving sheet.

26 Claims, 11 Drawing Sheets

SUBLIMATION TYPE THERMOSENSITIVE IMAGE TRANSFER RECORDING MEDIUM

BACKGROUND OF THE INVENTION

The present invention relates to a sublimation type thermosensitive image transfer recording medium.

Recently the demand for full color printers is increasing year by year. Representative recording methods for full color printers now available are the electrophotographic method, the ink-jet method, and the thermosensitive image transfer method. Of these methods, the thermosensitive image transfer method is most employed because of its advantages over the other methods that the maintenance is easy and the operation is noiseless.

In the thermosensitive image transfer recording method, a solidified color ink sheet and a receiving sheet are employed, and a color ink is transferred imagewise from the ink sheet to the receiving sheet by the thermal fusing of the ink or by the sublimation of the ink, with application of thermal energy by laser beams or a thermal head under the control by electric signals.

Thus, the thermosensitive image transfer recording method can be roughly classified into two types, a thermal fusing image transfer type and sublimation image transfer type. The sublimation image transfer type has the advantages over the thermal fusing type that halftone can be obtained without difficulty and image gradation can be controlled as desired because in this image transfer, a sublimable dye is in principle sublimated in the form of independent molecules in such an amount as to correspond to the amount of thermal energy applied thereto, for instance, through a thermal head. Therefore, it is considered that the sublimation image transfer type is most suitable for color printers.

The sublimation image transfer recording method, however, has the shortcoming that its running cost is high, because in this image transfer method, a yellow ink sheet, a magenta ink sheet, a cyan ink sheet and when necessary, a black ink sheet, are employed for obtaining a full-color image, with selective application of thermal energy to each ink sheet and discarded after the recording, even though large unused portions are remained in each ink sheet.

In order to eliminate this shortcoming, there are proposed (1) an equal speed mode in which an ink sheet and a receiving sheet are moved at the same speed for using the ink sheet in repetition and (2) an N-times use mode in which the running speed of the ink sheet is made smaller than that of the receiving sheet so that the overlappingly used portions of the ink sheet at the first use and the second use are shifted little by little.

In the sublimation type thermosensitive image transfer recording method, the sublimation and evaporation reaction is fundamentally a reaction of zero order. Therefore, in the equal speed mode, the ink sheet cannot be used multiple times for printing because the the printed image density significantly decreases as the number of the printing increases, particularly in high image density areas, even though a sufficient amount of a dye for multiple printing is contained in the ink layer of the ink sheet.

Furthermore, in the N-times use mode, the multiple printing performance is improved, but it has the risk that an ink layer and an image receiving layer become fused and improper running of the ink sheet takes place when the running speeds of both the ink layer and the image receiving layer are not made equal.

SUMMARY OF THE INVENTION

It is therefore an object of the present invention to provide a sublimation type thermosensitive image transfer recording medium, which does not cause drastic decrease in transferred image density even when it is used multiple times.

The above object of the present invention is attained by a sublimation type thermosensitive image transfer recording medium comprising (1) a support, (2) a dye supplying layer comprising a sublimable dye and an organic binder agent in which the sublimable dye is dissolved or dispersed, and (3) an image transfer facilitating layer comprising the sublimable dye and an organic binder agent in which the sublimable dye is dissolved or dispersed, which image transfer facilitating layer facilitates the dispersion of the sublimable dye contained in the dye supplying layer from its free surface thereof to a receiving sheet for thermosensitive image transfer printing, thereby facilitating the image transfer, which layers are successively overlaid on the support. The dye supplying layer and the image transfer facilitating layer are structured in such a manner that when the dye supplying layer and the image transfer facilitating layer are separately formed on a substrate, and they are separately superimposed on the same receiving sheet, and the same quantity of thermal energy is applied thereto, the amount (weight/unit time·unit area) of the sublimable dye transferred from the dye supplying layer to the receiving sheet is greater than the amount (weight/unit time·unit area) of the sublimable dye transferred from the image transfer facilitating layer to the receiving sheet.

DETAILED DESCRIPTION OF THE PREFERRED EMBODIMENTS

Figure 2:
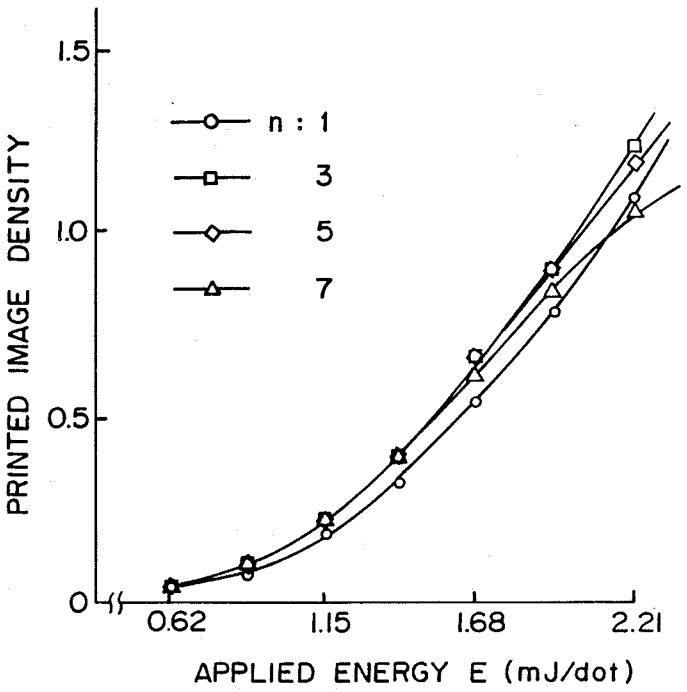
FIGS. 2, 3, 4, 5, 7, 8, 9, 11, 12, 13 and 14 are the graphs showing the relationship between the printed image density (reflected image density) and the applied thermal energy obtained by each of sublimination type thermosensitive image transfer recording media No. 1 to No. 11 according to the present invention.

In the present invention, both the dye supplying layer and the image transfer facilitating layer comprise a sublimable dye and an organic binder agent.

In the present invention, Fick's law can be applied to the diffusion of a dye contained in the dye supplying layer and the image transfer facilitating layer which constitute an ink layer. More specifically, the amount (dn) of the dye which passes through the sectional area (q) of the ink layer for a period of time (dt) is represented by the following equation:

$$dn = -D(dc/dx)qdt$$

where dc/dx is the dye concentration gradient in the direction of the diffusion of the dye, and D is the average diffusion coefficient in each section of the ink layer.

In order to facilitate the diffusion of a sublimable dye from the dye supplying layer to the image transfer facilitating layer, the following two methods are available:

(1) The concentration of the dye in the dye supplying layer is made greater than that of the dye in the image transfer facilitating layer.

(2) The diffusion coefficient of the dye in the dye supplying layer is made greater than that of the dye in the image transfer facilitating layer.

Specific means for carrying out the second method are described, for example, in "Fiber Association Journal" (Sen'i Gakkaishi) Vol. 30, No. 12 (974) by Toyoko Sakai et al; "Dyeing Theoretical Chemistry" by Norihiko Kuroki (published by Maki Shoten) page 503; and "First Non-impact Printing Technologies Symposium Papers" No. 3 to No. 5.

With reference to the above articles, more specific methods for carrying out the second method are as follows:

(a) A method of using as the organic binder agent in the image transfer facilitating layer an organic polymeric material having more proton-donating groups or proton-accepting groups, with which sublimable dyes may easily form hydrogen bonds therebetween, as compared with an organic binder agent, since the diffusion coefficient of a dye is effected by an energy control effect on the diffusion of the dye, such as the hydrogen bond between the dyes and organic binder agents. In other words, in this method, in the image transfer facilitating layer, an organic binder agent having a greater capability of bonding with the sublimation dye than the capability of the organic binder agent of bonding with the sublimation dye in the dye supplying layer is employed.

(b) A method of using an organic binder agent in the dye supplying layer, which has a lower glass transition temperature or a lower softening point than the glass transition or softening point of an organic binder agent contained in the image transfer facilitating layer, since the diffusion coefficient of the dye depends upon the glass transition temperature or the softening point of the organic binder agent in which the dye is dispersed.

(c) A method of containing a plasticizer in the dye supplying layer, which is compatible with at least one organic binder agent in the dye supplying layer, and not compatible with any of organic binder agents contained in the image transfer facilitating layer.

(d) A method of using any or all of the above-mentioned methods (a), (b) and (c) in combination.

As a matter of course, any other methods capable of satisfying the above-mentioned relationship concerning the diffusion coefficient can be employed.

When designing the formulations of the dye supplying layer and the image transfer facilitating layer for use in the present invention, the above-mentioned methods (1) and (2) are useful. Whether or not the desired effect is attained by any of the above methods can be easily confirmed by separately forming the dye supplying layer and the image transfer facilitating layer on a substrate, with an equal deposition amount of the components of each layer with each formulation, superimposing each of the dye supplying layer and the image transfer layer on a receiving sheet, and applying an equal amount of thermal energy thereto for sublimation of the dyes from the two layers onto the receiving sheet, to confirm the relationship that the amount (weight/unit time·unit area) of the sublimable dye transferred from the dye supplying layer to the receiving sheet is greater than the amount (weight/unit time·unit area) of the sublimable dye transferred from the image transfer facilitating layer to the receiving sheet.

The dye supplying layer has a thickness, preferably in the range of 0.1 μm to 20 μm, more preferably in the range of 0.5 μm to 5 μm, while the image transfer facilitating layer has a thickness, preferably in the range of 0.05 μm to 5 μm, more preferably in the range of 0.1 μm to 2 μm.

The sublimable dyes available for use in the dye supplying layer and the image transfer facilitating layer are those employed conventionally, which are volatilized or sublimed at 60° C. or above, specifically those employed in thermal transfer printing, for example, disperse dyes and oil-soluble dyes. Specific examples of such dyes are C.I. Disperse Yellow 1, 3, 8, 9, 16, 41, 54, 60, 77 and 116; C.I. Disperse Red 1, 4, 6, 11, 15, 17, 55, 59, 60, 73 and 83; C.I. Disperse Blue 3, 14, 19, 26, 56, 60, 64, 72, 99 and 108; C.I. Solvent Yellow 77 and 116; C.I. Solvent Red 23, 25 and 27; and Solvent Blue 36, 83 and 105. These dyes can be used alone or in combination.

The binder agents available for use in the dye supplying layer and the image transfer facilitating layer are thermoplastic resins and thermosetting resins. Of those resins, examples of the resins having relatively high glass transition points or relatively high softening points are vinyl chloride resin, vinyl acetate resin, polyamide, polyethylene, polycarbonate, polystyrene, polypropylene, acrylic resin, phenolic resin, polyester, polyurethane, epoxy resin, silicone resin, fluorine-contained resin, butyral resin, malamine resin, natural rubber, synthetic rubber, polyvinyl alcohol, and cellulose resins. These resins can be used alone or in combination, or in the form of copolymers.

The dye supplying layer may further comprise a wax component. This is because in general the bonding force between a wax component and a dye component is so weak that the wax component does not absorb the dye component, so that the wax component has a function of facilitating the release of the dye component from the dye supplying layer when heated. Therefore, when a wax component is contained in the dye supplying layer, while when no wax component is added to the image transfer facilitaing layer, the dye releasing function of the dye supplying layer can be increased in comparison with that of the image transfer facilitating layer.

Examples of such a wax component for use in the dye supplying layer are as follows:

I. Natural waxes

1. Vegetable waxes, such as candelill wax, carnauba wax, rice wax, and haze wax.
2. Animal waxes, such as beeswax, lanolin, and spermaceti.
3. Mineral waxes, such as montan wax, ozocerite, and ceresin.

II. Synthetic Waxes

1. Petroleum waxes such as paraffin wax, microcrystalline wax, and petrolactam.

2. Hydrocarbon type waxes such as wax via Fischer-Tropish synthesis and polyethylene wax.
3. Modified waxes such as montan wax derivatives, paraffin wax derivatives, and microcrystalline wax derivatives.
4. Hydrogenated waxes such as hardened castor oil and hardened castor oil derivatives.
5. Fatty acids, acid amides, esters, ketones and others such as 12-hydroxystearic acid, stearamide, phthalic anhydride amide, and chlorinated hydrocarbon.

III. Combined waxes

It is preferable that the amount of the wax component be in the range of 0.1 to 10 parts by weight, more preferably in the range of 0.1 to 1 part by weight, to 1 part by weight of the resin components including the organic binder agent in the dye supplying layer.

In order to make the dye supplying layer and the image transfer facilitating layer different in terms of the glass transition temperature or softening point thereof, resins, and natural or synthetic rubbers having glass transition temperatures of 0° C. or less, or softening points of 60° C. or less may be employed for the dye supplying layer.

Specific examples of such resins, natural rubbers and synthetic rubbers are as follows:

syn-diotactic 1,2-polybutadiene (commercially available from Japan Synthetic Rubber Co., Ltd. under the trademarks of JSR RB810, 820, and 830), acidic or non-acidic acid containing olefin copolymers and terpolymers (commercially available from Dexon Chemical Co., Ltd. under the trademarks of Dexson XEA-7), ethylene-vinyl acetate copolymer (commercially available from Allied Fibers & Plastics under the trademarks of 400 & 400A, 405, 430; and from Du Pont-Mitsui Polychemicals Co., Ltd. under the trademarks of P-3307 (EV150) and P-2807(EV250)); low-molecular weight polyolefin polyol and derviatives thereof (commercially available from Mitsubishi Chemical Industries, Ltd. under the trademarks of Polytail H, and HE); brominated epoxy resins (commercially available from Toto Chemical Co., Ltd. under the trademarks of YDB-340, 400, 500, 600); novolak type epoxy resin (commercially available from Toto Chemical Co., Ltd. under the trademarks of YDCN-701, 702, 703); thermoplastic acryl solutions (commercially available from Mitsubishi Rayon Engineering Co., Ltd. under the trademarks of Dianal LR1075, 1080, 1081, 1082, 1063, and 1079); thermoplastic acryl emulsions (comercially available from Mitsubishi Rayon Engineering Co., Ltd. under the trademarks of LX-400 and LX-450); polyethylene oxide (commercially available from Meisei Chemical Works, Ltd. under the trademarks of Alkox E-30, 45, Alkox R-150, 400, 1000); caprolactone polyol (commercially available from Daicel Chemical Industries, Ltd. under the trademarks of Placcel H-1, 4, 7). In particular, polyethylene oxide and polycaprolactone polyol are preferable for use in practice. It is also preferable that these resins be used in combination with the previously mentioned one or more thermoplastic or thermosetting resins.

The concentration of the sublimable dye contained in the image transfer facilitating layer is preferably in the range of 5 wt.% to 80 wt.%, more preferably in the range of about 10 wt.% to 60 wt.%, while the concentration of the sublimable dye contained in the dye supplying layer is preferably in the range of 5 wt.% to 80 wt.%. In order to make a dye concentration gradient between the image transfer facilitating layer and the dye supplying layer, the dye concentration in the dye supplying layer is preferably 1.1 to 5 times, more preferably 1.5 to 3 times, the dye concentration in the image transfer facilitating layer.

The materials for the support of the recording medium according to the present invention are, for example, films such as condenser paper, polyester film, polystyrene film, polysulfone film, polyimide film, and polyaminde film.

A conventionally employed adhesive layer may be interposed between the support made of any of the above sheets and the dye supplying layer, and a conventionally employed heat resistant lubrication layer may be formed on the back side of the support opposite to the dye supplying layer.

The plasticizers to be contained in the dye supplying layer, previously mentioned in the practice (c) in the method (2) are defined as such materials that come between molecules of a resin and reduce tha van der Waals' forces between the molecules by which the hard network structure of the resin is formed, and consequently decreasing the second order transition temperature of the resin. Further the term "compatibility" is defined as both the plasticizer and the resin having affinity for each other, with high gelation rate, and the plasticizer not being separated from the resin.

Plasticizers and resins for use in the present invention can be selected as desired, with the compatibility thereof taken into consideration, from various publications, catalogs and references, for example, "Plastic Ingredients", page 17-, by Sakura Yamada, published by Taisheisha Co., Ltd. and "Chemical Products of 1988", page 745-, published by Kagaku Kogyo Niopposha, Co., Ltd.

Specific examples of combinations of plasticizers, compatible resins, and non-compatible resins are as follows, in which plasticizers and compatible resins are used in the dye supplying layer, while non-compatible resins are employed in the image transfer facilitating layer.

| Plasticiers | Compatible Resins | Non-compatible Resins |
|---|---|---|
| Tricresyl phosphate | Acetycellulose<br>Acetylbutylcellulose<br>Ethycellulose<br>Acrylic resin<br>Acetylbutyl resin<br>Butyral resin | Polyvinylidene chloride<br>Polyamide |
| Tri-2-ethyl hexyl-phosphate | Nitrocellulose<br>Ethylcellulose<br>Butyral resin<br>Vinyl chloride resin | Acetylcellulose<br>Acetylbutylcellulose<br>Vinyl acetate resin |
| Triphenyl phosphate | Acetylcellulose<br>Ethylcellulose<br>Vinyl acetate resin | Butyral resin<br>Polyamide |
| Di-2-ethyl hexyl-phthalate | Acetylbutylcellulose<br>Ethylcellulose<br>Bytyral resin<br>Vinyl chloride resin<br>Nitrocellulose | Acetylcellulose<br>Vinyl acetate resin<br>Polyamide |
| Diisodecyl phthalate | Acetylbutylcellulose<br>Nitrocellulose<br>Ethylcellluose<br>Butyral resin | Acetylcellulose<br>Polyvinyl acetate<br>Polyamide |
| Ditridecyl hexyl-phthalate | Vinyl acetate resin<br>Vinyl chloride resin | Acetylcellulose<br>Acetylbutylcellulose<br>Ethylcellulose<br>Butyral resin |

The above listed plasticizers are particularly preferable for use in the present invention because they are excellent in heat resistance and volatility.

The ratio of the added amount of the plasticizers to the amount of the resins is preferably 10 to 100 wt.%, more preferably 10 to 50 wt.%.

In the so far explained recording medium, the dye layer is divided into two layers, that is, the dye supplying layer and the image transfer facilitating layer. The dye layer can be into more than two layers as long as the separated functions intended in the present invention are attained, with appropriate differences in the amount of the dyes transferred therebetween.

In the present invention, thermal image transfer may be carried out by use of a thermal head, by laser beams, using a support which absorb laser beams and generates heat therefrom, or by causing an electric current to flow through the support and/or an ink-containing layer formed thereon so as to generate Joule's heat therein, that is, by the so-called electrothermic non-impact printing. The electrothermic non-impact printing method is described in many references, such as U.S. Pat. No. 4,103,066, Japanese Laid-Open Patent Applications No. 57-14060, 57-11080 and 59-9096.

When the electrothermic non-impact printing method is employed, as the support for the thermosensitive image transfer recording medium according to the present invention, supports which are modified to have an intermediate electric resistivity between electroconductive materials and insulating materials, for example, by dispersing finely-divided electroconductive particles, such as finely-divided metal particles of aluminum, copper, iron, tin, zinc, nickel, molybudenum, and silver, and/or carbon black, in a resin having relatively good heat resistance, such as polyester, polycarbonate, triacetylcellulose, nylon, polyimide, and aromatic polyamides, or by using a support of the above-mentioned resins, with the above-mentioned electroconductive metals deposited thereon by vacuum deposition or sputtering.

It is preferable that the thickness of such supports be in the range of about 2 μm to about 15 μm, when the thermal conductivity thereof for the generated Joule's heat is taken into consideration.

As mentioned above, when laser beams are employed for image transfer, it is preferable that the support absorb laser beams and generates heat. For this purpose, for example, a support comprising a conventional thermal transfer film with addition thereto a material which absorbs heat and convert the light into heat, such as carbon black, may be employed. Alternatively, a light-absorbing and heat-generating layer may be laminated on the front and/or back side of the support.

The features of this invention will become apparent in the course of the following description of exemplary embodiments which are given for illustration of the invention and are not intended to be limiting thereof.

EXAMPLE 1

[Preparation of Dye Supplying Layer]

A mixture of the following components was dispersed in a ball mill for 24 hours, whereby a dye supplying layer coating dispersion No. 1 was prepared:

| | Parts by Weight |
|---|---|
| Polyvinyl butyral resin (Trademark "BX-1" made by Sekisui Chemical Co., Ltd.) | 10 |
| Sublimable dye Kayaset Blue 714 (made by Nippon Kayaku Co., Ltd.) | 20 |
| Solvents: Toluene | 100 |
| Methyl ethyl ketone | 100 |

[Preparation of Image Transfer Facilitating Layer]

A mixture of the following components was dispersed in a ball mill for 24 hours, whereby an image transfer facilitating layer coating dispersion No. 1 was prepared:

| | Parts by Weight |
|---|---|
| Polyvinyl butyral resin (Trademark "BX-1" made by Sekisui Chemical Co., Ltd.) | 10 |
| Sublimable dye Kayaset Blue 714 (made by Nippon Kayaku Co., Ltd.) | 10 |
| Solvents: Toluene | 100 |
| Methyl ethyl ketone | 100 |

Figure 1:
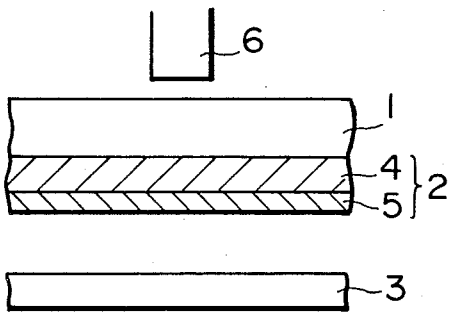
FIG. 1 is a schematic illustration in explanation of the structure of a sublimation type thermosensitive image transfer medium according to the present invention.

The dye supplying layer coating dispersion No. 1 was coated by a wire bar on a polyimide film having a thickness of 8.5 μm (made by Toray-DuPont Co., Ltd.) serving as a support 1 as illustrated in FIG. 1, whereby a dye supplying layer 4 having a thickness of 2.40 μm when dried was formed on the support 1. Subsequently, the image transfer facilitating layer coating dispersion No. 1 was coated by a wire bar on the dye supplying layer 4 and dried, whereby an image transfer facilitating layer 5 having a thickness of 0.61 μm when dried was formed on the dye supplying layer 4, thus a sublimation type thermosensitive image transfer recording medium No. 1 according to the present invention was prepared. In this recording medium, the dye supplying layer 4 and the image transfer facilitating layer 5 constitutes a thermally transferable ink layer 2 as illustrated in FIG. 1.

The thus prepared sublimation type thermosensitive image transfer recording medium No. 1 was subjected to a thermal recording, using a thermal head 6, for multiple printing from an identical spot of the recording medium onto a receiving sheet 3 for sublimation type thermosensitive recording, which is commercially available as an image receiving sheet with a trademark of Supply VY-S100 for Hitachi Video Printer VY-50, under the printing conditions that the applied power was 442 mW/dot, and the maximum applied energy was 2.21 mJ/dot. The relationship between the applied thermal energy E (mJ/dot) and the printed image density was investigated for the multiple repeated printing with a repetition number changed from 1 to 7, using a Macbeth Densitometer RD-514. The result are shown in the graph of FIG. 2, which indicate that there was no substantial difference between the printed densities obtained in the first printing through the 7th printing.

EXAMPLE 2

[Preparation of Dye Supplying Layer]

A mixture of the following components was dispersed in a ball mill for 24 hours, whereby a dye supplying layer coating dispersion No. 2 was prepared:

| | Parts by Weight |
|---|---|
| Polyvinyl butyral resin (Trademark "BX-1" made by Sekisui Chemical Co., Ltd., having a glass transition temperature of about 83° C.) | 1 |
| Polyethylene oxide (Trademark "Alkox" made by Meisei Chemical Works, Ltd., having a glass transition temperature of about −60° C.) | 9 |
| Sublimable dye Kayaset Blue 714 (made by Nippon Kayaku Co., Ltd.) | 10 |
| Solvents: Toluene | 100 |
| Methyl ethyl ketone | 100 |

The dye supplying layer coating dispersion No. 2 was coated by a wire bar on a polyimide film having a thickness of 8.5 μm (made by Toray-DuPont Co., Ltd.) serving as a support, whereby a dye supplying layer having a thickness of 2.40 μm when dried was formed on the support. Subsequently, the image transfer facilitating layer coating dispersion No. 1 which was prepared in Example 1 was coated by a wire bar on the dye supplying layer and dried, whereby an image transfer facilitating layer having a thickness of 0.61 μm when dried was formed on the dye supplying layer, thus a sublimation type thermosensitive image transfer recording medium No. 2 according to the present invention was prepared.

The thus prepared sublimation type thermosensitive image transfer recording medium No. 2 was subjected to the same thermal recording for multiple printing as in Example 1.

Figure 3:
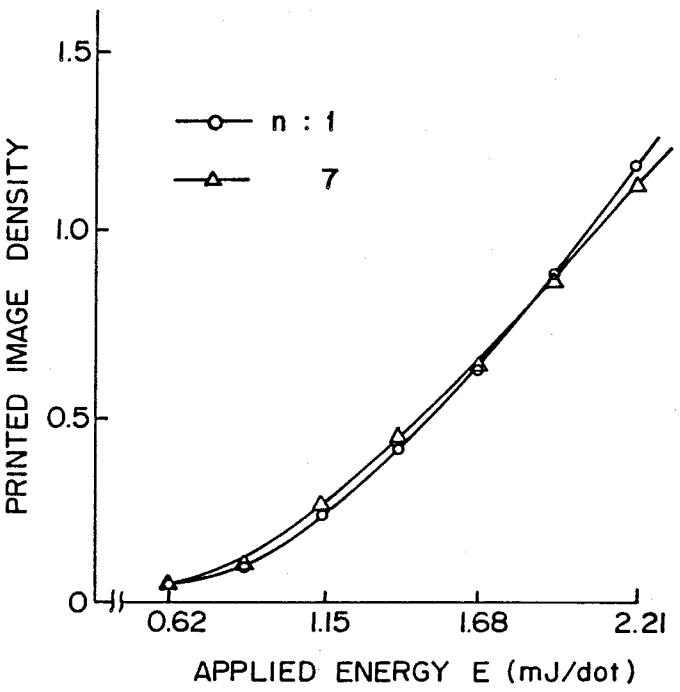

The results are shown in the graph of FIG. 3, which indicate that there was no substantial difference between the printed densities obtained in the first printing through the 7th printing as in the case of the sublimation type thermosensitive image transfer recording medium No. 1 in Example 1.

EXAMPLE 3

[Preparation of Dye Supplying Layer]

A mixture of the following components was dispersed in a ball mill for 24 hours, whereby a dye supplying layer coating dispersion No. 3 was prepared:

| | Parts by Weight |
|---|---|
| Polyvinyl butyral resin (Trademark "BX-1" made by Sekisui Chemical Co., Ltd., having a glass transition temperature of about 83° C.) | 1 |
| Polycaprolacton (Trademark "Placcel H-7" made by Daicel Chemical Industries, Ltd., having a glass transition temperature of about −60° C.) | 9 |
| Sublimable dye Kayaset Blue 714 (made by Nippon Kayaku Co., Ltd.) | 10 |
| Solvents: Toluene | 100 |
| Methyl ethyl ketone | 100 |

The dye supplying layer coating dispersion No. 3 was coated by a wire bar on a polyimide film having a thickness of 8.5 μm (made by Toray-DuPont Co., Ltd.) serving as a support, whereby a dye supplying layer having a thickness of 2.40 μm when dried was formed on the support. Subsequently, the image transfer facilitating layer coating dispersion No. 1 which was prepared in Example 1 was coated by a wire bar on the dye supplying layer and dried, whereby an image transfer facilitating layer having a thickness of 0.61 μm when dried was formed on the dye supplying layer, thus a sublimation type thermosensitive image transfer recording medium No. 3 according to the present invention was prepared.

The thus prepared sublimation type thermosensitive image transfer recording medium No. 3 was subjected to the same thermal recording for multiple printing as in Example 1.

Figure 4:
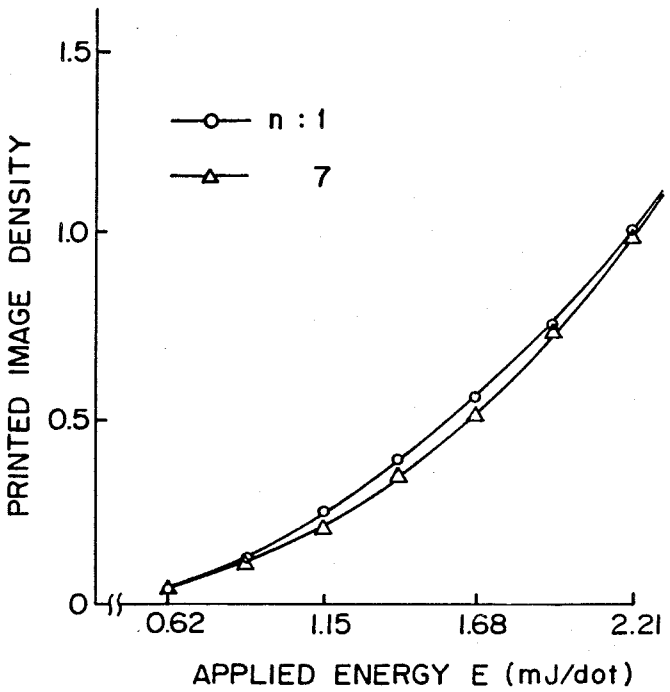

The results are shown in the graph of FIG. 4, which indicate that there was no substantial difference between the printed densities obtained in the first printing through the 7th printing as in the case of the sublimation type thermosensitive image transfer recording medium No. 1 in Example 1.

EXAMPLE 4

[Preparation of Dye Supplying Layer]

A mixture of the following components was dispersed in a ball mill for 24 hours, whereby a dye supplying layer coating dispersion No. 4 was prepared:

| | Parts by Weight |
|---|---|
| Cellulose.Acetate.Butylate Resin (Trademark "CAB-381-0.5" made by Eastman Kodak Co., Ltd., having a glass transition temperature of about 130° C.) | 10 |
| Sublimable dye Kayaset Blue 714 (made by Nippon Kayaku Co., Ltd.) | 20 |
| Solvents: Toluene | 100 |
| Methyl ethyl ketone | 100 |

The dye supplying layer coating dispersion No. 4 was coated by a wire bar on a polyimide film having a thickness of 8.5 μm (made by Toray-DuPont Co., Ltd.) serving as a support, whereby a dye supplying layer having a thickness of 2.40 μm when dried was formed on the support. Subsequently, the image transfer facilitating layer coating dispersion No. 1 which was prepared in Example 1 was coated by a wire bar on the dye supplying layer and dried, whereby an image transfer facilitating layer having a thickness of 0.61 μm when dried was formed on the dye supplying layer, thus a sublimation type thermosensitive image transfer recording medium No. 4 according to the present invention was prepared.

The thus prepared sublimation type thermosensitive image transfer recording medium No. 4 was subjected to the same thermal reading for multiple printing as in Example 1.

Figure 5:
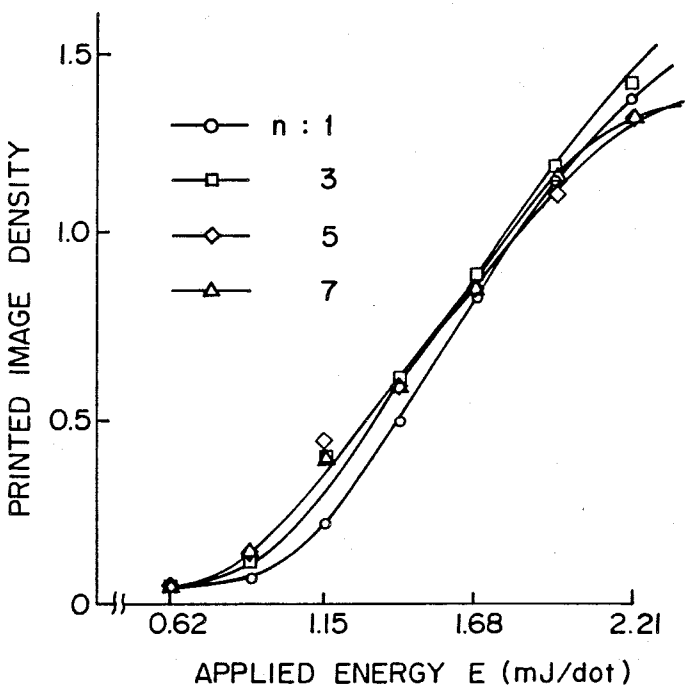

The results are shown in the graph of FIG. 5, which indicate that there was no substantial difference between the printed densities obtained in the first printing through the 7th printing as in the case of the sublimation type thermosensitive image transfer recording medium No. 1 in Example 1.

COMPARATIVE EXAMPLE 1

The image transfer facilitating layer coating dispersion No. 1 which was prepared in Example 1 was coated by a wire bar on a polyimide film having a thickness of 8.5 μm (made by Toray-DuPont Co., Ltd.), so that an ink layer having a thickness of 3.0 μm when dried was formed on the polyimide film. Thus, a comparative sublimation type thermosensitive image transfer recording medium No. 1 was prepared.

The thus prepared comparative sublimation type thermosensitive image transfer recording medium No. 1 was subjected to the same thermal recording for multiple printing as in Example 1.

Figure 6:
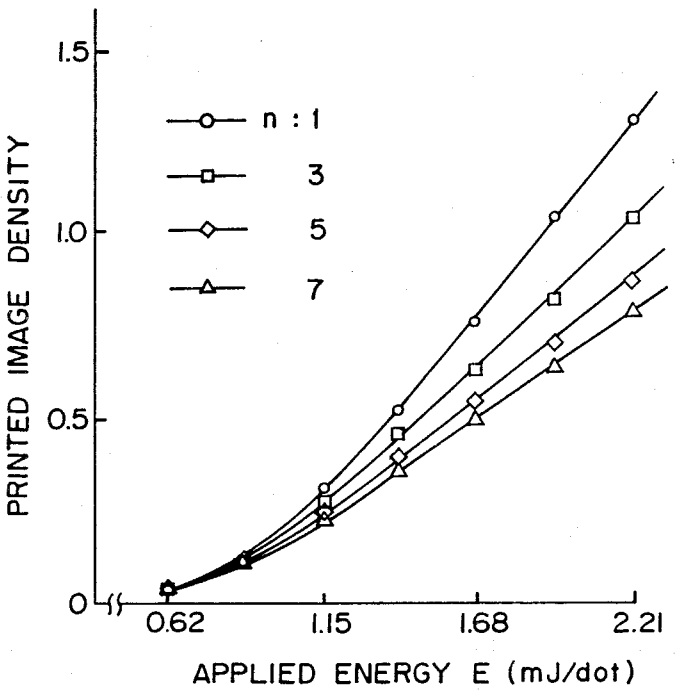
FIGS. 6, 10 and 15 are the graphs showing the relationship between the the printed image density (reflected image density) and the applied thermal energy obtained by each of comparative sublimation type thermosensitive image transfer recording medium No. 1, No. 2 and No. 3.

The results are shown in the graph of FIG. 6, which indicate that the printed image density considerably decreased as the number of the printing was increased.

EXAMPLE 5

[Preparation of Dye Supplying Layer]

A mixture of the following components was dispersed in a ball mill for 24 hours, whereby a dye supplying layer coating dispersion No. 5 was prepared:

| | Parts by Weight |
|---|---|
| Ethylcellulose | 10 |
| Sublimable dye Kayaset Blue 714 (made by Nippon Kayaku Co., Ltd.) | 10 |
| Solvents: Toluene | 100 |
| Methyl ethyl ketone | 100 |

[Preparation of Image Transfer Facilitating Layer]

A mixture of the following components was dispersed in a ball mill for 24 hours, whereby an image transfer facilitating layer coating dispersion No. 2 was prepared:

| | Parts by Weight |
|---|---|
| Polyvinyl butyral resin (Trademark "BX-1" made by Sekisui Chemical Co., Ltd.) | 10 |
| Sublimable dye Kayaset Blue 714 (made by Nippon Kayaku Co., Ltd.) | 10 |
| Solvents: Toluene | 100 |
| Methyl ethyl ketone | 100 |

The dye suplying layer coating dispersion No. 5 was coated by a wire bar on a polyimide film having a thickness of 8.5 μm (made by Toray-DuPont Co., Ltd.), whereby a dye supplying layer having a thickness of 2.40 μm when dried was formed on the polyimide film. Subsequently, the image transfer facilitating layer coating dispersion No. 2 was coated by a wire bar on the dye supplying layer and dried, whereby an image transfer facilitating layer having a thickness of 0.61 μm when dried was formed on the dye supplying layer, thus a sublimation type thermosensitive image transfer recording medium No. 5 according to the present invention was prepared.

The thus prepared sublimation type thermosensitive image transfer recording medium No. 5 was subjected to the same thermal recording for multiple printing as in Example 1.

Figure 7:
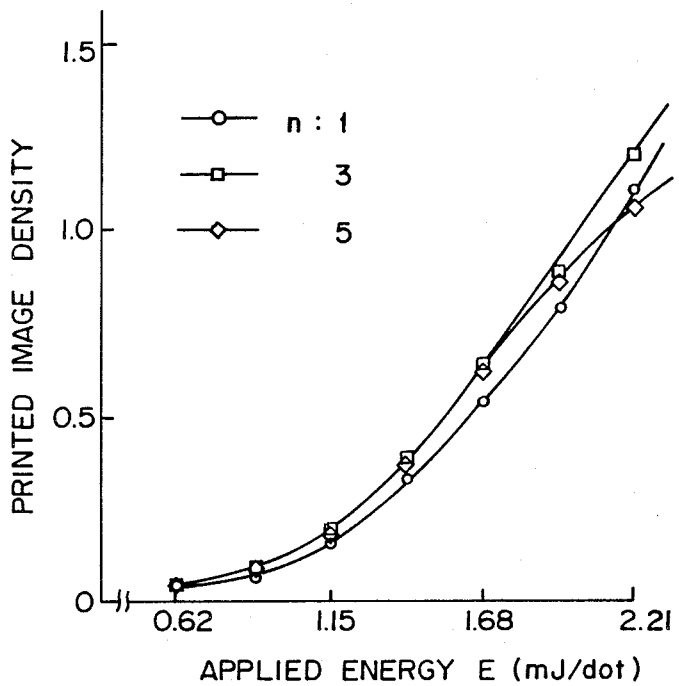

The results are shown in the graph of FIG. 7, which indicate that there was no substantial difference between the printed densities obtained in the first printing through the 7th printing as in the case of the sublimation type thermosensitive image transfer recording medium No. 1 in Example 1.

EXAMPLE 6

[Preparation of Dye Supplying Layer]

A mixture of the following components was dispersed in a ball mill for 24 hours, whereby a dye supplying layer coating dispersion No. 6 was prepared:

| | Parts by Weight |
|---|---|
| Polyvinyl butyral resin | 10 |
| Di-2-ethylhexyl phthalate | 10 |
| Sublimable dye Kayaset Blue 714 (made by Nippon Kayaku Co., Ltd.) | 10 |
| Solvents: Toluene | 100 |
| Methyl ethyl ketone | 100 |

[Preparation of Image Transfer Facilitating Layer]

A mixture of the following components was dispersed in a ball mill for 24 hours, whereby an image transfer facilitating layer coating dispersion No. 3 was prepared:

| | Parts by Weight |
|---|---|
| Acetylcellulose resin | 10 |
| Sublimable dye Kayaset Blue 714 (made by Nippon Kayaku Co., Ltd.) | 10 |
| Solvents: Toluene | 100 |
| Methyl ethyl ketone | 100 |

The dye supplying layer coating dispersion No. 6 was coated by a wire bar on a polyimide film having a thickness of 8.5 μm (made by Toray-DuPont Co., Ltd.), whereby a dye supplying layer having a thickness of 2.40 μm when dried was formed on the polyimide film. Subsequently, the image transfer facilitating layer coating dispersion No. 3 was coated by a wire bar on the dye supplying layer and dried, whereby an image transfer facilitating layer having a thickness of 0.61 μm when dried was formed on the dye supplying layer, thus a sublimation type thermosensitive image transfer recording medium No. 6 according to the present invention was prepared.

The thus prepared sublimation type thermosensitive image transfer recording medium No. 6 was subjected to the same thermal recording for multiple printing as in Example 1.

Figure 8:
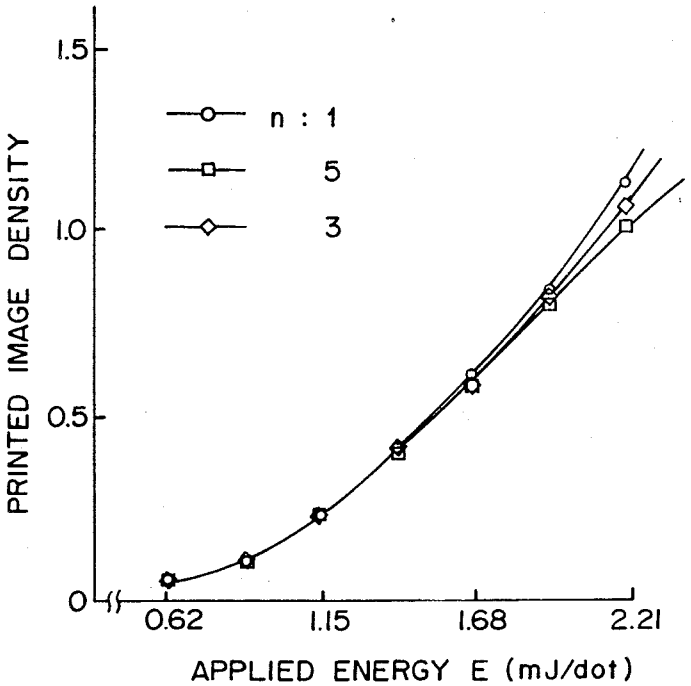

The results are shown in the graph of FIG. 8, which indicate that there was no substantial difference between the printed densities obtained in the first printing through the 7th printing as in the case of the sublimation type thermosensitive image transfer recording medium No. 1 in Example 1.

EXAMPLE 7

[Preparation of Dye Supplying Layer]

A mixture of the following components was dispersed in a ball mill for 24 hours, whereby a dye supplying layer coating dispersion No. 7 was prepared:

| | Parts by Weight |
|---|---|
| Polyvinyl butyral resin | 10 |
| Di-isodecyl phthalate | 10 |
| Sublimable dye Kayaset Blue 714 (made by Nippon Kayaku Co., Ltd.) | 10 |
| Solvents: Toluene | 100 |
| Methyl ethyl ketone | 100 |

[Preparation of Image Transfer Facilitating Layer]

A mixture of the following components was dispersed in a ball mill for 24 hours, whereby an image transfer facilitating layer coating dispersion No. 3, which is the same as that employed in Example 6, was prepared:

| | Parts by Weight |
|---|---|
| Acetylcellulose resin | 10 |
| Sublimable dye Kayaset Blue 714 (made by Nippon Kayaku Co., Ltd.) | 10 |
| Solvents: Toluene | 100 |
| Methyl ethyl ketone | 100 |

The dye supplying layer coating dispersion No. 7 was coated by a wire bar on a polyimide film having a thickness of 8.5 μm (made by Toray-DuPont Co., Ltd.), whereby a dye supplying layer having a thickness of 2.40 μm when dried was formed on the polyimide film. Subsequently, the image transfer facilitating layer coating dispersion No. 3 was coated by a wire bar on the dye supplying layer and dried, whereby an image transfer facilitating layer having a thickness of 0.61 μm when dried was formed on the dye supplying layer, thus a sublimation type thermosensitive image transfer recording medium No. 7 according to the present invention was prepared.

The thus prepared sublimation type thermosensitive image transfer recording medium No. 7 was subjected to the same thermal recording for multiple printing as in Example 1.

Figure 9:
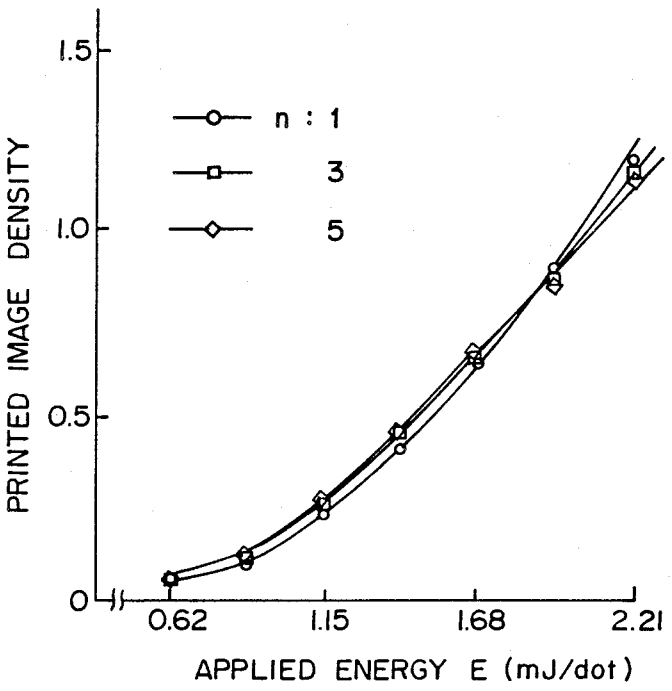

The results are shown in the graph of FIG. 9, which indicate that there was no substantial difference between the printed densities obtained in the first printing through the 7th printing as in the case of the sublimation type thermosensitive image transfer recording medium No. 1 in Example 1.

COMPARATIVE EXAMPLE 2

[Preparation of Dye Supplying Layer]

A mixture of the following components was dispersed in a base mill for 24 hours, whereby a dye comparative supplying layer coating dispersion No. 1 was prepared:

| | Parts by Weight |
|---|---|
| Polyvinyl butyral resin | 10 |
| Sublimable dye Kayaset Blue 714 | 10 |
| (made by Nippon Kayaku Co., Ltd.) | 10 |
| p-tert-butylphenol | 10 |
| Solvents: Toluene | 100 |
| Methyl ethyl ketone | 100 |
| Methyl ethyl ketone | 100 |

The above dye supplying layer coating dispersion was coated by a wire bar on a polyimide film having a thickness of 8.5 μm (made by Toray-DuPont Co., Ltd.), whereby a dye supplying layer having a thickness of 2.40 μm when dried was formed on the polyimide film. Subsequently, the image transfer facilitating layer coating dispersion No. 2 which was employed in Example 5, was coated by a wire bar on the dye supplying layer and dried, whereby an image transfer facilitating layer having a thickness of 0.61 μm when dried was formed on the dye supplying layer, thus a comparative sublimation type thermosensitive image transfer recording medium No. 2 was prepared.

The p-tert-butylphenol employed in the dye supplying layer is compatible with the resins in both the dye supplying layer and the image transfer facilitating layer, so that there was substantially no difference between the average diffusion coefficients of the two layers.

The thus prepared comparative sublimation type thermosensitive image transfer recording medium No. 2 was subjected to the same thermal recording for multiple printing as in Example 1.

Figure 10:
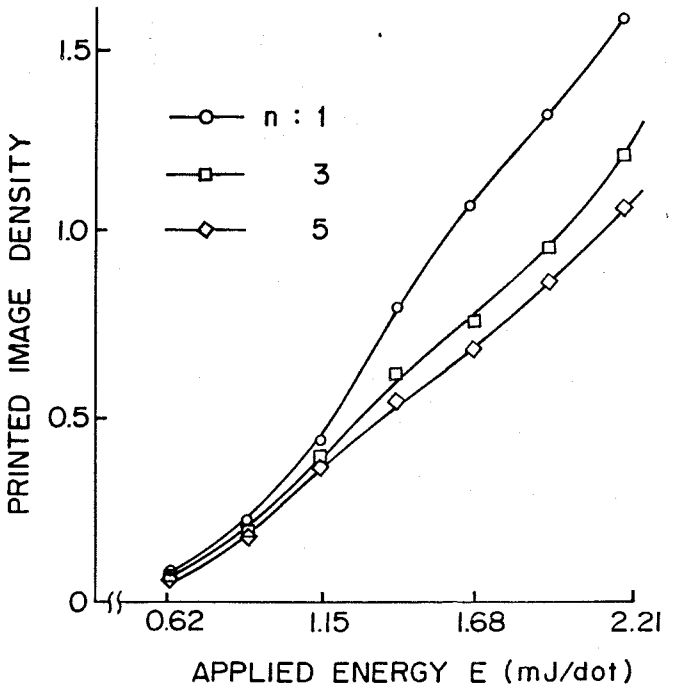

The results are shown in the graph of FIG. 10, which indicate that the printed image density considerably decreased as the number of the printing was increased.

EXAMPLE 8

[Preparation of Dye Supplying Layer]

A mixture of the following components was dispersed in a ball mill for 24 hours, whereby the same dye supplying layer coating dispersion No. 1 as that employed in Example 1 was prepared:

| | Parts by Weight |
|---|---|
| Polyvinyl butyral resin (Trademark "BX-1" made by Sekisui Chemical Co., Ltd.) | 10 |
| Sublimable dye Kayaset Blue 714 (made by Nippon Kayaku Co., Ltd.) | 20 |
| Solvents: Toluene | 100 |
| Methyl ethyl ketone | 100 |

[Preparation of Image Transfer Facilitating Layer]

A mixture of the following components was dispersed in a ball mill for 24 hours, whereby the same image transfer facilitating layer coating dispersion No. 1 as that employed in Example 1 was prepared:

| | Parts by Weight |
|---|---|
| Polyvinyl butyral resin (Trademark "BX-1" made by Sekisui Chemical Co., Ltd.) | 10 |
| Sublimable dye Kayaset Blue 714 (made by Nippon Kayaku Co., Ltd.) | 10 |
| Solvents: Toluene | 100 |
| Methyl ethyl ketone | 100 |

[Preparation of Electrothermic Support]

Aluminum was deposited in vacuum with a thickness of 0.08 μm on an base sheet consisting of 65 wt.% of an aromatic polyamide and 35 wt.% of electroconductive carbon, having a thickness of 6 μm and an intermediate electric resistivity, whereby an electrothermic support was prepared.

The dye supplying layer coating dispersion No. 1 was coated by a wire bar on the aluminum-deposited side of the above prepared electrothermic support, serving as a support 1 as illustrated in FIG. 1, whereby a dye supplying layer 4 having a thickness of 2.40 μm when dried was formed on the electrothermic support 1. Subsequently, the image transfer facilitating layer coating dispersion No. 1 was coated by a wire bar on the dye supplying layer 4 and dried, whereby an image transfer facilitating layer 5 having a thickness of 0.61 μm when dried was formed on the dye supplying layer 4, thus a sublimation type thermosensitive image transfer recording medium No. 8 according to the present invention was prepared.

The thus prepared sublimation type thermosensitive image transfer recording medium No. 8 was subjected to an electrothermic non-impact recording for multiple printing from an identical spot of the recording medium onto a receiving sheet 3 for sublimation type thermosensitive recording, which is commercially available as an image receiving sheet with a trademark of Supply VY-S100 for Hitachi Video Printer VY-50, using an electrothermic recording head, under the printing conditions that the head density of the electrothermic recording head was 6 dots/mm, the applied voltage was 14 volts, the pulse width was 0.2 to 3.2 ms, and the maximum applied energy was 45 mJ/mm$^2$.

Figure 11:
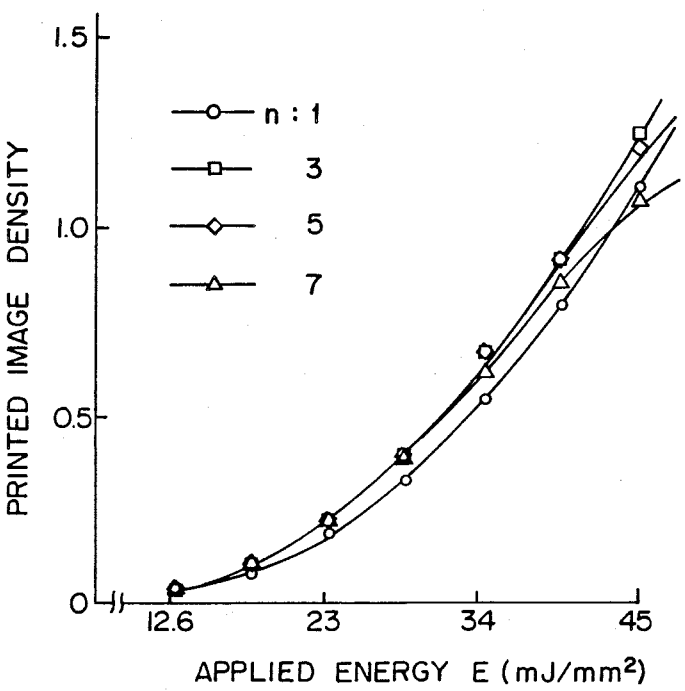

The relationship between the applied thermal energy E (mJ/dot) and the printed image density was investigated for the multiple repeated printing with a repetition number changed from 1 to 7, using a Macbeth Densitometer RD-514. The results are shown in the graph of FIG. 11, which indicate that there was no substantial difference between the printed densities obtained in the first printing through the 7th printing.

EXAMPLE 9

[Preparation of Dye Supplying Layer]

A mixture of the following components was dispersed in a ball mill for 24 hours, whereby the same dye supplying layer coating dispersion No. 2 as that employed in Example 2 was prepared:

| | Parts by Weight |
|---|---|
| Polyvinyl butyral resin (Trademark "BX-1" made by Sekisui Chemical Co., Ltd., having a glass transition temperature of about 83° C.) | 1 |
| Polyethylene oxide (Trademark "Alkox" made by Meisei Chemical Works, Ltd., having a glass transition temperature of about −60° C.) | 9 |
| Sublimable dye Kayaset Blue 714 (made by Nippon Kayaku Co., Ltd.) | 10 |
| | 10 |
| Solvents: Toluene | 100 |
| Methyl ethyl ketone | 100 |

The dye supplying layer coating dispersion No. 2 was coated by a wire bar on the same electrothermic base as that employed in Example 8, whereby a dye supplying layer having a thickness of 2.40 μm when dried was formed on the support. Subsequently, the image transfer facilitating layer coating dispersion No. 1 which was prepared in Example 1 was coated by a wire bar on the dye supplying layer and dried, whereby an image transfer facilitating layer having a thickness of 0.61 μm when dried was formed on the dye supplying layer, thus a sublimation type thermosensitive image transfer recording medium No. 9 according to the present invention was prepared.

The thus prepared sublimation type thermosensitive image transfer recording medium No. 9 was subjected to the same electrothermic non-impact recording for multiple printing as in Example 8.

Figure 12:
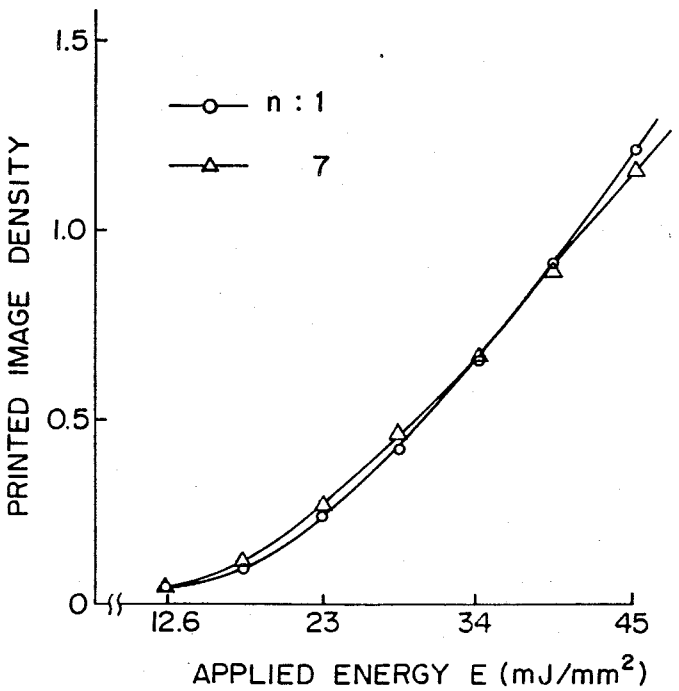

The results are shown in the graph of FIG. 12, which indicate that there was no substantial difference between the printed densities obtained in the first printing through the 7th printing as in the case of the sublimation type thermosensitive image transfer recording medium No. 8 in Example 8.

EXAMPLE 10

[Preparation of Dye Supplying Layer]

A mixture of the following components was dispersed in a ball mill for 24 hours, whereby the same dye supplying layer coating dispersion No. 3 as that employed in Example 3 was prepared:

| | Parts by Weight |
|---|---|
| Polyvinyl butyral resin (Trademark "BX-1" made by Sekisui Chemical Co., Ltd., having a glass transition temperature of about 83° C.) | 1 |
| Polycaprolacton (Trademark "Placcel H-7" made by Daicel Chemical Industries, Ltd., having a glass transition temperature of about −60° C.) | 9 |
| Sublimable dye Kayaset Blue 714 (made by Nippon Kayaku Co., Ltd.) | 10 |
| Solvents: Toluene | 100 |
| Methyl ethyl ketone | 100 |

The dye supplying layer coating dispersion No. 3 was coated by a wire bar on the same electrothermic base as that employed in Example 8, whereby a dye supplying layer having a thickness of 2.40 μm when dried was formed on the support. Subsequently, the image transfer facilitating layer coating dispersion No. 1 which was prepared in Example 1 was coated by a wire bar on the dye supplying layer and dried, whereby an image transfer facilitating layer having a thickness of 0.61 μm when dried was formed on the dye supplying layer, thus a sublimation type thermosensitive image transfer recording medium No. 10 according to the present invention was prepared.

The thus prepared sublimation type thermosensitive image transfer recording medim No. 10 was subjected to the same electrothermic non-impact recording for multiple printing as in Example 8.

Figure 13:
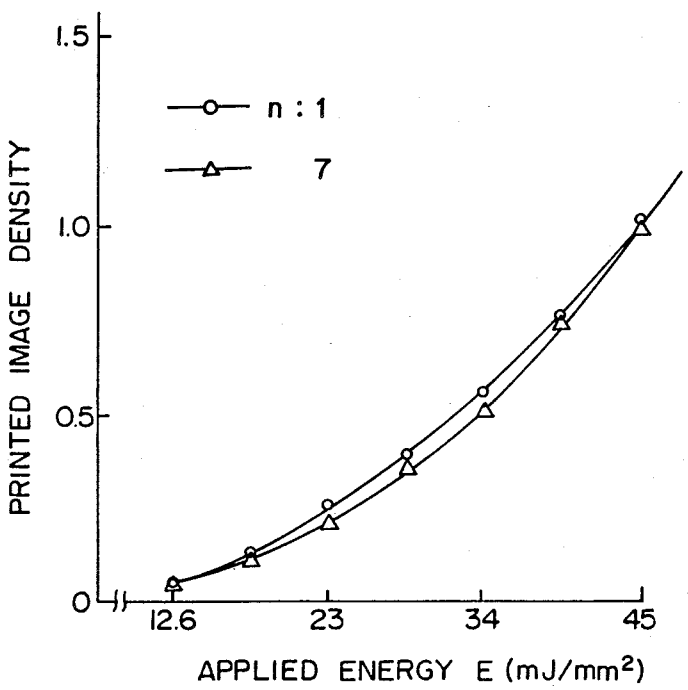

The results are shown in the graph of FIG. 13, which indicate that there was no substantial difference between the printed densities obtained in the first printing through the 7th printing as in the case of the sublimation type thermosensitive image transfer recording medium No. 8 in Example 8.

EXAMPLE 11

[Preparation of Dye Supplying Layer]

A mixture of the following components was dispersed in a ball mill for 24 hours, whereby the same dye supplying layer coating dispersion No. 4 as that employed in Example 4 was prepared:

| | Parts by Weight |
|---|---|
| Cellulose-Acetate-Butylate Resin (Trademark "CAB-381-0.5" made by Eastman Kodak Co., Ltd., having a glass transition temperature of about 130° C.) | 10 |
| Sublimable dye Kayaset Blue 714 (made by Nippon Kayaku Co., Ltd.) | 20 |
| Solvents: Toluene | 100 |
| Methyl ethyl ketone | 100 |

The dye supplying layer coating dispersion No. 4 was coated by a wire bar on the same electrothermic base as that employed in Example 8, whereby a dye supplying layer having a thickness of 2.40 μm when dried was formed on the support. Subsequently, the image transfer facilitating layer coating dispersion No. 1 which was prepared in Example 1 was coated by a wire bar on the dye supplying layer and dried, whereby an image transfer facilitating layer having a thickness of 0.61 μm when dried was formed on the dye supplying layer, thus a sublimation type thermosensitive image transfer recording medium No. 11 according to the present invention was prepared.

The thus prepared sublimation type thermosensitive image transfer recording medium No. 11 was subjected to the same electrothermic non-impact recording for multiple printing as in Example 8.

Figure 14:
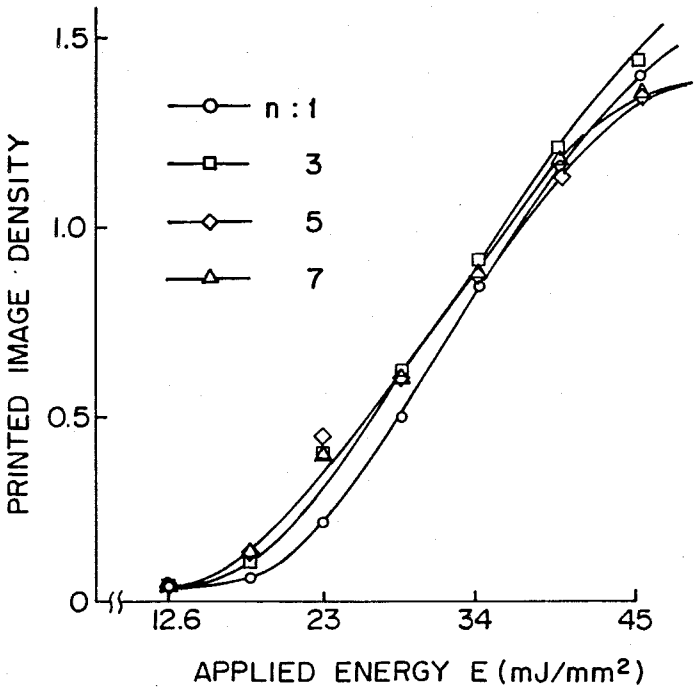

The results are shown in the graph of FIG. 14, which indicate that there was no substantial difference between the printed densities obtained in the first printing through the 7th printing as in the case of the sublimation type thermosensitive image transfer recording medium No. 8 in Example 8.

COMPARATIVE EXAMPLE 3

The image transfer facilitating layer coating dispersion No. 1 which was prepared in Example 1 and employed in Example 8 as well was coated by a wire bar on the same electrothermic base as that employed in Example 8, whereby an ink layer having a thickness of 3.01 μm when dried was formed on the support. Thus, a comparative sublimation type thermosensitive image transfer recording medium No. 3 was prepared.

The thus prepared comparative sublimation type thermosensitive image transfer recording medium No. 3 was subjected to the same electrothermic non-impact recording for multiple printing as in Example 8.

Figure 15:
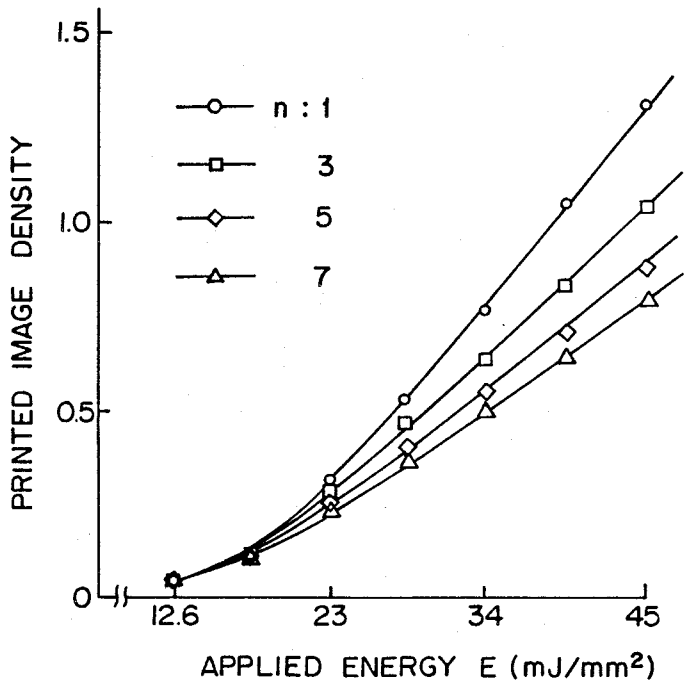

The results are shown in the graph of FIG. 15, which indicate that the printed image density considerably decreased as the number of the printing was increased.

EXAMPLE 12

A mixture of the following components was dispersed in a bal mill for 24 hours, whereby a dye supplying layer coating dispersion No. 8 was prepared:

| | Parts by Weight |
|---|---|
| Polyvinyl butyral resin (Trademark "BX-1" made by Sekisui Chemical Co., Ltd.) | 7 |
| Paraffin wax (Trademark "Paraffin wax 155" made by Nippon Seiro Co., Ltd.) | 3 |
| Sublimable dye Kayaset Blue 714 (made by Nippon Kayaku Co., Ltd.) | 10 |
| Solvents: Toluene | 70 |
| Methyl ethyl ketone | 70 |

[Preparation of Image Transfer Facilitating Layer]

A mixture of the following components was dispersed in a ball mill for 24 hours, whereby the image transfer facilitating layer coating dispersion No. 1 which was employed in Example 1 was prepared:

| | Parts by Weight |
|---|---|
| Polyvinyl butyral resin (Trademark "BX-1" made by Sekisui Chemical Co., Ltd.) | 10 |
| Sublimable dye Kayaset Blue 714 (made by Nippon Kayaku Co., Ltd.) | 10 |
| Solvents: Toluene | 100 |
| Methyl ethyl ketone | 100 |

The dye supplying layer coating dispersion No. 8 was coated by a wire bar on a polyimide film having a thickness of 8.5 μm (made by Toray-DuPont Co., Ltd.) serving as a support, whereby a dye supplying layer having a thickness of 3.00 μm when dried was formed on the support. Subsequently, the image transfer facilitating layer coating dispersion No. 1 was coated by a wire bar on the dye supplying layer and dried, whereby an image transfer facilitating layer having a thickness of 0.84 μm when dried was formed on the dye supplying layer, thus a sublimation type thermosensitive image transfer recording medium No. 12 according to the present invention was prepared.

The thus prepared sublimation type thermosensitive image transfer recording medium No. 12 was subjected to a thermal recording for multiple printing from an identical spot of the recording medium onto a receiving sheet for sublimation type thermosensitive recording, which is commercially available as an image receiving sheet with a trademark of Supply VY-S100 for Hitachi Video Printer VY-50, using a thermal head of 6 dots/mm, with application of a maximum printing energy of 3.00 mJ/dot.

Figure 16:
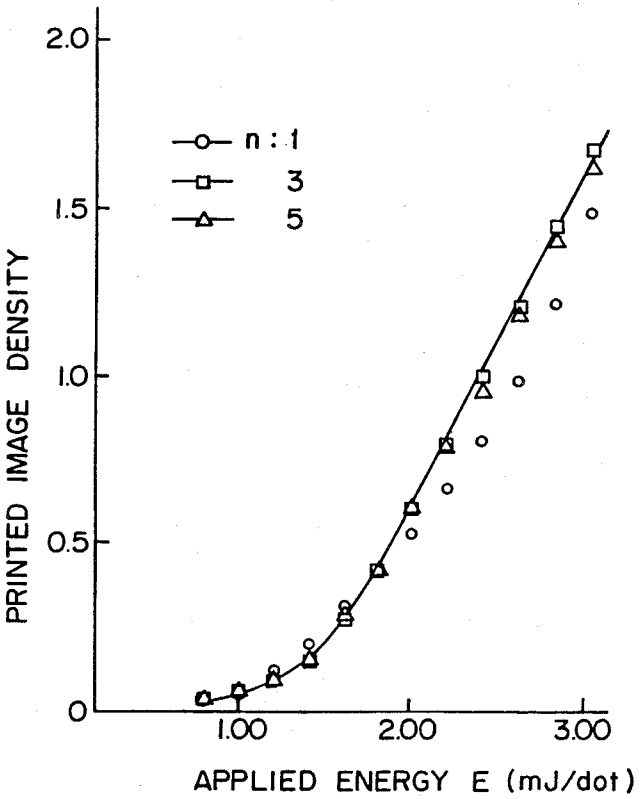

The relationship between the applied thermal energy E (mJ/dot) and the printed image density was investigated for the multiple repeated printing with a repetition number changed from 1 to 5. The results are shown in the graph of FIG. 16, which indicate that there was no substantial difference between the printed densities obtained in the first printing through the 5th printing.

EXAMPLE 13

[Preparation of Dye Supplying Layer]

A mixure of the following components was dispersed in a ball mill for 24 hours, whereby a dye supplying layer coating dispersion No. 9 was prepared:

| | Parts by Weight |
|---|---|
| Polyvinyl butyral resin (Trademark "BX-1" made by Sekisui Chemical Co., Ltd., having a glass transition temperature of about 83° C.) | 7 |
| Carnauba wax (Trademark "Purified Carnauba Wax No. 1" made by Noda Wax Co., Ltd.) | 3 |
| Sublimable dye Kayaset Blue 714 (made by Nippon Kayaku Co., Ltd.) | 10 |
| Solvents: Toluene | 100 |
| Methyl ethyl ketone | 100 |

[Preparation of Image Transfer Facilitating Layer]

A mixture of the following components was dispersed in a ball mill for 24 hours, whereby the image transfer facilitating layer coating dispersion No. 1 which was employed in Example 1 was prepared:

| | Parts by Weight |
|---|---|
| Polyvinyl butyral resin (Trademark "BX-1" made by Sekisui Chemical Co., Ltd.) | 10 |
| Sublimable dye Kayaset Blue 714 (made by Nippon Kayaku Co., Ltd.) | 10 |
| Solvents: Toluene | 100 |
| Methyl ethyl ketone | 100 |

The dye supplying layer coating dispersion No. 9 was coated by a wire bar on a polyimide film having a thickness of 8.5 μm (made by Toray-DuPont Co., Ltd.) serving as a support, whereby a dye supplying layer having a thickness of 8.5 μm when dried was formed on the support. Subsequently, the image transfer facilitating layer coating dispersion No. 1 was coated by a wire bar on the dye supplying layer and dried, whereby an image transfer facilitating layer having a thickness of 0.84 μm when dried was formed on the dye supplying layer, thus a sublimation type thermosensitive image transfer recording medium No. 13 according to the present invention was prepared.

The thus prepared sublimation type thermosensitive image transfer recording medium No. 13 was subjected to the same thermal recording for multiple printing as in Example 12.

Figure 17:
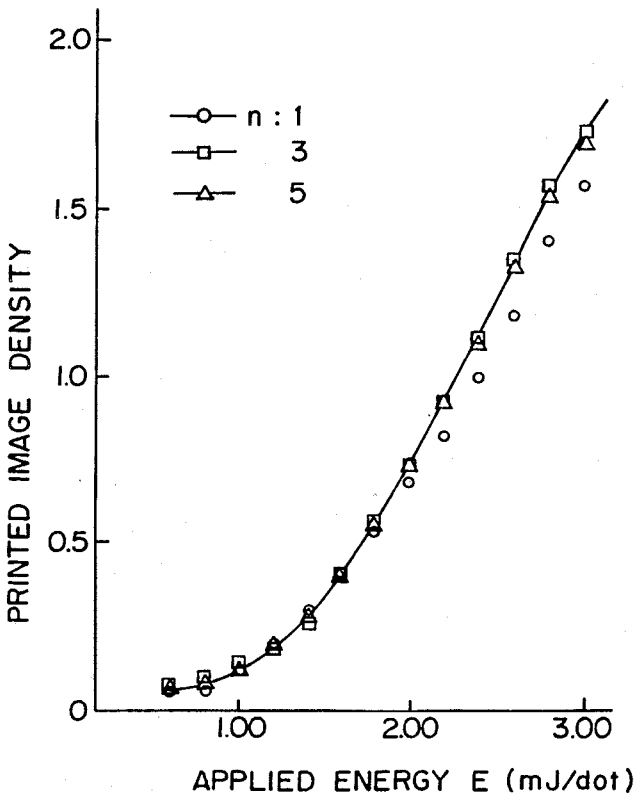
FIGS. 16 to 21 are the graphs showing the relationship between the printed image density (reflected image density) and the applied thermal energy obtained by each of sublimation type thermosensitive image transfer recording media No. 12 to No. 17 according to the present invention.

The results are shown in the graph of FIG. 17, which indicate that there was no substantial difference between the printed densities obtained in the first printing through the 5th printing as in the case of the sublimation type thermosensitive image transfer recording medium No. 12 in Example 12.

EXAMPLE 14

[Preparation of Dye Supplying Layer]

A mixture of the following components was dispersed in a ball mill for 24 hours, whereby a dye supplying layer coating dispersion No. 10 was prepared:

| | Parts by Weight |
|---|---|
| Polyvinyl butyral resin (Trademark "BX-1" made by Sekisui Chemical Co., Ltd., having a glass transition temperature of about 83° C.) | 7 |
| Montan wax (Trademark "Wax Montan BJ" made by Hoechst Japan) | 3 |
| Sublimable dye Kayaset Blue 714 (made by Nippon Kayaku Co., Ltd.) | 10 |
| Solvents: Toluene | 70 |
| Methyl ethyl ketone | 70 |

[Preparation of Image Transfer Facilitating Layer]

A mixture of the following components was dispersed in a bal mill for 24 hours, whereby the image transfer facilitating layer coating dispersion No. 1 which was employed in Example 1 was prepared:

| | Parts by Weight |
|---|---|
| Polyvinyl butyral resin (Trademark "BX-1" made by Sekisui Chemical Co., Ltd.) | 10 |
| Sublimable dye Kayaset Blue 714 (made by Nippon Kayaku Co., Ltd.) | 10 |
| Solvents: Toluene | 100 |
| Methyl ethyl ketone | 100 |

The dye supplying layer coating dispersion No. 10 was coated by a wire bar on a polyimide film having a thickness of 8.5 μm (made by Toray-DuPont Co., Ltd.) serving as a support, whereby a dye supplying layer having a thickness of 3.0 μm when dried was formed on the support. Subsequently, the image transfer facilitating layer coating dispersion No. 1 was coated by a wire bar on the dye supplying layer and dried, whereby an image transfer facilitating layer having a thickness of 0.84 μm when dried was formed on the dye supplying layer, thus a sublimation type thermosensitive image transfer recording medium No. 14 according to the present invention was prepared.

The thus prepared sublimation type thermosensitive image transfer recording medium No. 14 was subjected to the same thermal recording for multiple printing as in Example 12.

Figure 18:
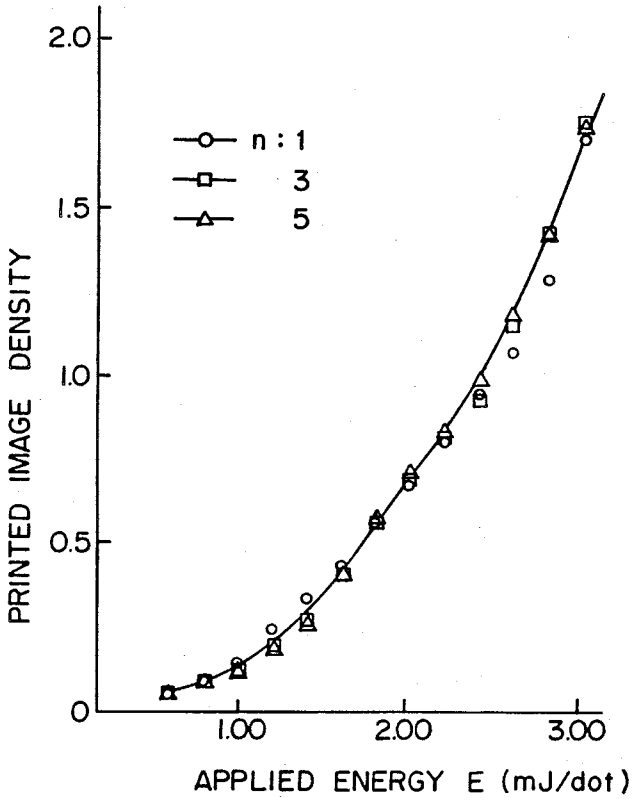

The results are shown in the graph of FIG. 18, which indicate that there was no substantial difference between the printed densities obtained in the first printing through the 5th printing as in the case of the sublimation type thermosensitive image transfer recording medium No. 12 in Example 12.

EXAMPLE 15

[Preparation of Dye Supplying Layer]

A mixture of the following components was dispersed in a ball mill for 24 hours, whereby a dye supplying layer coating dispersion No. 11 was prepared:

| | Parts by Weight |
|---|---|
| Cellulose·Acetate·butylate Resin (Trademark "CAB-381-0.5" made by Eastman Kodak Co., Ltd., having a glass transition temperature of about 130° C.) | 7 |
| Lanolin wax (Trademark "Lanolin Wax FPG-1" made by Yoshikawa Oil & Fat Co., Ltd.) | 3 |
| Sublimable dye Kayaset Blue 714 (made by Nippon Kayaku Co., Ltd.) | 10 |
| Solvents: Toluene | 70 |
| Methyl ethyl ketone | 70 |

[Preparation of Image Transfer Facilitating Layer]

A mixture of the following components was dispersed in a ball mill for 24 hours, whereby an image transfer facilitating layer coating dispersion No. 5 was prepared:

| | Parts by Weight |
|---|---|
| Cellulose·Acetate·Butylate Resin (Trademark "CAB-381-0.5" made by Eastman Kodak Co., Ltd., having a glass transition temperature of about 130° C.) | 10 |
| Sublimable dye Kayaset Blue 714 (made by Nippon Kayaku Co., Ltd.) | 10 |
| Solvents: Toluene | 100 |
| Methyl ethyl ketone | 100 |

The dye supplying layer coating dispersion No. 11 was coated by a wire bar on a polyimide film having a thickness of 8.5 μm (made by Toray-DuPont Co., Ltd.) serving as a support, whereby a dye supplying layer having a thickness of 3.00 μm when dried was formed on the support. Subsequently, the image transfer facilitating layer coating dispersion No. 5 was coated by a wire bar on the dye supplying layer and dried, whereby an image transfer facilitating layer having a thickness of 0.84 μm when dried was formed on the dye supplying layer, thus a sublimation type thermosensitive image transfer recording medium No. 15 according to the present invention was prepared.

The thus prepared sublimation type thermosensitive image transfer recording medium No. 15 was subjected to the same thermal recording for multiple printing as in Example 12.

Figure 19:
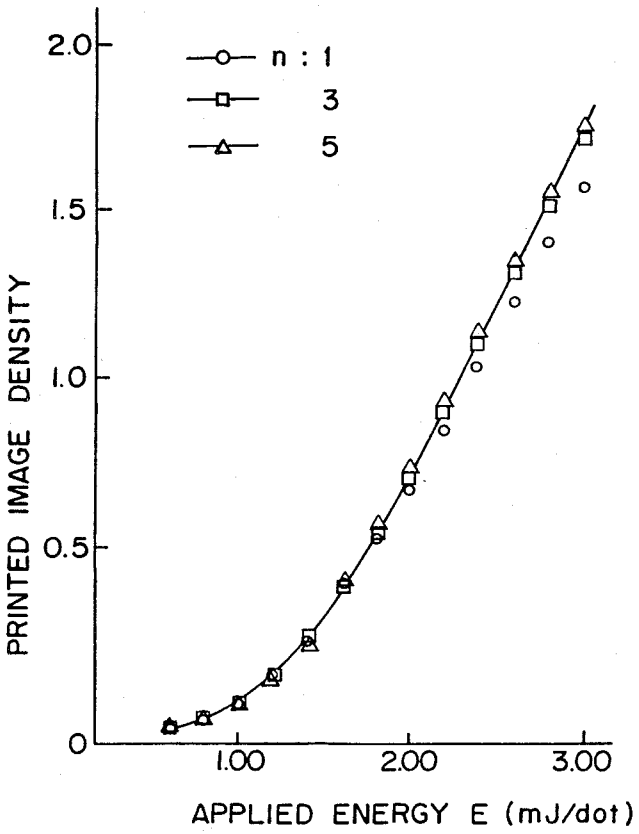

The results are shown in the graph of FIG. 19, which indicate that there was no substantial difference between the printed densities obtained in the first printing through the 5th printing as in the case of the sublimation type thermosensitive image transfer recording medium No. 12 in Example 12.

EXAMPLE 16

[Preparation of Dye Supplying Layer]

A mixture of the following components was dispersed in a ball mill for 24 hours, whereby a dye supplying layer coating dispersion No. 12 was prepared:

| | Parts by Weight |
|---|---|
| Cellulose·Acetate·Butylate Resin (Trademark "CAB-381-0.5" made by Eastman Kodak Co., Ltd., having a glass transition temperature of about 130° C.) | 7 |
| Polyethylene wax (Trademark "High Wax 320 MP") | 3 |
| Sublimable dye Kayaset Blue 714 (made by Nippon Kayaku Co., Ltd.) | 10 |
| Solvents: Toluene | 70 |
| Methyl ethyl ketone | 70 |

[Preparation of Image Transfer Facilitating Layer]

A mixture of the following components was dispersed in a ball mill for 24 hours, whereby the image transfer facilitating layer coating dispersion No. 5, which was employed in Example 15, was prepared:

| | Parts by Weight |
|---|---|
| Cellulose·Acetate·Butylate Resin (Trademark "CAB-381-0.5" made by Eastman Kodak Co., Ltd., having a glass transition temperature of about 130° C.) | 10 |
| Sublimable dye Kayaset Blue 714 (made by Nippon Kayaku Co., Ltd.) | 10 |
| Solvents: Toluene | 100 |
| Methyl ethyl ketone | 100 |

The dye supplying layer coating dispersion No. 12 was coated by a wire bar on a polyimide film having a thickness of 8.5 μm (made by Toray-DuPont Co., Ltd.) serving as a support, whereby a dye supplying layer having a thickness of 3.00 μm when dried was formed on the support. Subsequently, the image transfer facilitating layer coating dispersion No. 5 was coated by a wire bar on the dye supplying layer and dried, whereby an image transfer facilitating layer having a thickness of 0.84 μm when dried was formed on the dye supplying layer, thus a sublimation type thermosensitive image transfer recording medium No. 16 according to the present invention was prepared.

The thus prepared sublimation type thermosensitive image transfer recording medium No. 16 was subjected to the same thermal recording for multiple printing as in Example 12.

Figure 20:
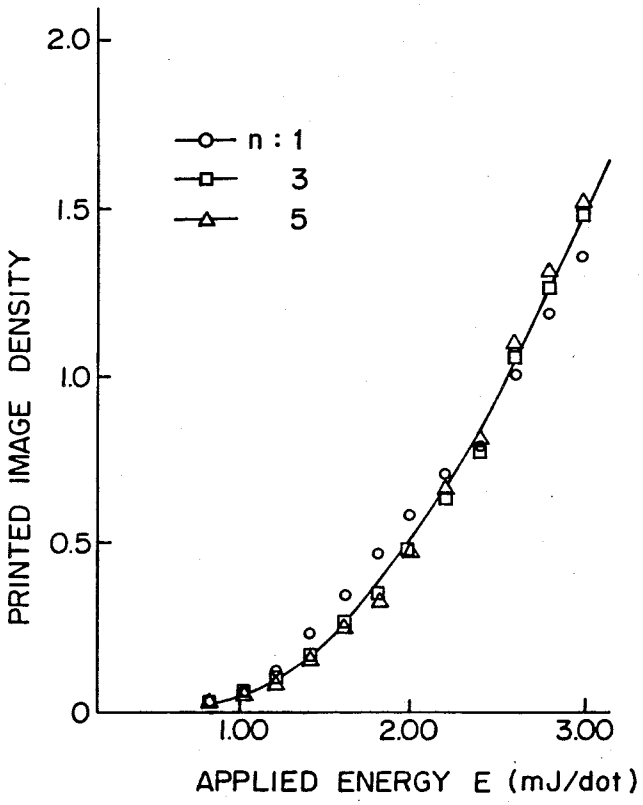

The results are shown in the graph of FIG. 20, which indicate that there was no substantial difference between the printed densities obtained in the first printing through the 5th printing as in the case of the sublimation type thermosensitive image transfer recording medium No. 12 in Example 12.

EXAMPLE 17

[Preparation of Dye Supplying Layer]

A mixture of the following components was dispersed in a ball mill for 24 hours, whereby a dye supplying layer coating dispersion No. 13 was prepared:

| | Parts by Weight |
|---|---|
| Cellulose·Acetate·Butylate Resin (Trademark "CAB-381-0.5" made by Eastman Kodak Co., Ltd., having a glass transition temperature of about 130° C.) | 7 |
| Microcrystalline wax (Trademark "High Wax 320 MP") | 3 |
| Sublimable dye Kayaset Blue 714 (made by Nippon Kayaku Co., Ltd.) | 10 |
| Solvents: Toluene | 70 |
| Methyl ethyl ketone | 70 |

[Preparation of Image Transfer Facilitating Layer]

A mixture of the following components was dispersed in a ball mill for 24 hours, whereby the image transfer facilitating layer coating dispersion No. 5, which was employed in Example 15, was prepared:

| | Parts by Weight |
|---|---|
| Cellulose·Acetate·Butylate Resin (Trademark "CAB-381-0.5" made by Eastman Kodak Co., Ltd., having a glass transition temperature of about 130° C.) | 10 |
| Sublimable dye Kayaset Blue 714 (made by Nippon Kayaku Co., Ltd.) | 10 |
| Solvents: Toluene | 100 |
| Methyl ethyl ketone | 100 |

The dye supplying layer coating dispersion No. 13 was coated by a wire bar on a polyimide film having a thickness of 8.5 μm (made by Toray-DuPont Co., Ltd.) serving as a support 1, whereby a dye supplying layer having a thickness of 3.00 μm when dried was formed on the support. Subsequently, the image transfer facilitating layer coating dispersion No. 5 was coated by a wire bar on the dye supplying layer and dried, whereby an image transfer facilitating layer having a thickness of 0.84 μm when dried was formed on the dye supplying layer, thus a sublimation type thermosensitive image transfer recording medium No. 17 according to the present invention was prepared.

The thus prepared sublimation type thermosensitive image transfer recording medium No. 17 was subjected to the same thermal recording for multiple printing as in Example 12.

Figure 21:
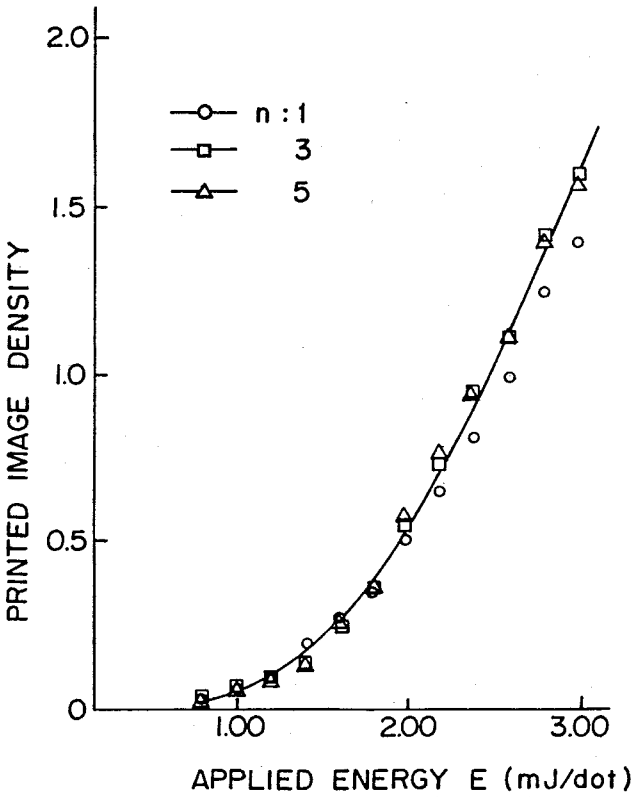

The results are shown in the graph of FIG. 21, which indicate that there was no substantial difference between the printed densities obtained in the first printing through the 5th printing as in the case of the sublimation type thermosensitive image transfer recording medium No. 12 in Example 12.

What is claimed is:

1. A sublimation type thermosensitive image transfer recording medium comprising:

a support;

a dye supplying layer formed on said support, comprising a sublimable dye and at least one binder agent in which said sublimable dye is dissolved or dispersed; and an image transfer facilitating layer formed on said dye supplying layer, comprising said sublimable dye and at least one organic binder agent in which said sublimable dye is dissolved or dispersed, said dye supplying layer and said image transfer facilitating layer being constructed in such a manner that (1) the concentration of said sublimable dye in said dye supplying layer is made greater than that of said sublimable dye in said image transfer facilitating layer or (2) the diffusion coefficient of said sublimable dye in said dye supplying layer is greater than that of said sublimable dye in said image transfer facilitating layer.

2. The sublimation type thermosensitive image transfer recording medium as claimed in claim 1, wherein the concentration of said sublimable dye in said dye supplying layer is 1.1 to 5 times the concentration of said sublimable dye in said image transfer facilitating layer.

3. The sublimation type thermosensitive image transfer recording medium as claimed in claim 2, wherein the concentration of said sublimable dye in said dye supplying layer is 1.5 to 3 times the concentration of said sublimable dye in said image transfer facilitating layer.

4. The sublimation type thermosensitive image transfer recording medium as claimed in claim 1, wherein the concentration of said sublimable dye in said dye supplying layer is in the range of 5 wt.% to 80 wt.%.

5. The sublimation type thermosensitive image transfer recording medium as claimed in claim 1, wherein the concentration of said sublimable dye in said image transfer facilitating layer is in the range of 5 wt.% to 80 wt.%.

6. The sublimation type thermosensitive image transfer recording medium as claimed in claim 5, wherein the concentration of said sublimable dye in said image transfer facilitating layer is in the range of about 10 wt.% to about 60 wt.%.

7. The sublimation type thermosensitive image transfer recording medium as claimed in claim 1, wherein said organic binder agent for said image transfer facilitating layer has a greater capability of bonding with said sublimable dye than the capability of said organic binder agent for said dye supplying layer of bonding with said sublimable dye.

8. The sublimation type thermosensitive image transfer recording medium as claimed in claim 1, wherein said organic binder agent for said dye supplying layer has a lower glass transition temperature or a lower softening point than the glass transition temperature or softening point of said organic binder agent for said image transfer facilitating layer.

9. The sublimation type thermosensitive image transfer recording medium as claimed in claim 8, wherein said organic binder agent for said image facilitating layer is selected from the group consisting of vinyl chloride resin, vinyl acetate resin, polyamide, polyethylene, polycarbonate, polystyrene, polypropylene, acrylic resin, phenolic resin, polyester, polyurethane, epoxy resin, silicone resin, fluorine-contained resin, butyral resin, melamine resin, natural rubber, synthetic rubber, polyvinyl alcohol, and cellulose resins.

10. The sublimation type thermosensitive image transfer recording medium as claimed in claim 8, wherein said organic binder agent for said dye supplying layer has a glass transition temperature of 0° C. or less or a softening point of 60° C. or less.

11. The sublimation type thermosensitive image transfer recording medium as claimed in claim 1, wherein said dye supplying layer further comprises a plasticizer which is compatible with at least one organic binder agent contained therein, and is not compatible with any organic binder agents contained in said image transfer facilitating layer.

12. The sublimation type thermosensitive image transfer recording medium as claimed in claim 11, wherein the amount of said plasticizer is in the range of 10 wt.% to 100 wt.% to the amount of said organic binder agent contained in said dye supplying layer.

13. The sublimation type thermosensitive image transfer recording medium as claimed in claim 1, wherein said dye supplying layer further comprises a wax component.

14. The sublimation type thermosensitive image transfer recording medium as claimed in claim 13, wherein said wax component is selected from the group consisting of vegetable waxes, animal waxes, mineral waxes, petroleum waxes, hydrocarbon type waxes, hydrogenated waxes, fatty acids, acid amides, esters and ketones.

15. The sublimation type thermosensitive image transfer recording medium as claimed in claim 13, wherein the amount of said wax component is in the range of 0.1 to 10 parts by weight to 1 part by weight of the resin components including said organic binder agent in said dye supplying layer.

16. The sublimation type thermosensitive image transfer recording medium as claimed in claim 1, wherein said sublimable dye is a dye which is volatilized or sublimed at 60° C. or above.

17. The sublimation type thermosensitive image transfer recording medium as claimed in claim 16, wherein said sublimable dye is selected from the group consisting of a disperse dye and an oil-soluble dye.

18. The sublimation type thermosensitive image transfer recording medium as claimed in claim 17, wherein said dispersed dye is selected from the group consisting of C.I. Disperse Yellow 1, 3, 8, 9, 16, 41, 54, 60, 77 and 116; C.I. Disperse Red 1, 4, 6, 11, 15, 17, 55, 59, 60, 73 and 83; C.I. Disperse Blue 3, 14, 19, 26, 56, 60, 64, 72, 99 and 108.

19. The sublimation type thermosensitive image transfer recording medium as claimed in claim 17, wherein said oil-soluble dye is selected from the group consisting of C.I. Solvent Yellow 77 and 116; C.I. Solvent Red 23, 25 and 27; and Solvent Blue 36, 83 and 105.

20. The sublimation type thermosensitive image transfer recording medium as claimed in claim 1, wherein said dye supplying layer has a thickness ranging from 0.1 μm to 20 μm, and said image transfer facilitating layer has a thickness anging from 0.05 μm to 5 μm.

21. The sublimation type thermosensitive image transfer recording medium as claimed in claim 1, wherein said support is made of a material selected from the group consisting of condenser paper, polyester film, polystyrene film, polysulfone film, polyimide film and polyamide film.

22. The sublimation type thermosensitive image transfer recording medium as claimed in claim 1, wherein said support is made of a material which absorbs laser beams to generate heat therefrom.

23. The sublimation type thermosensitive image transfer recording medium as claimed in claim 1, wherein said support is made of a material which generates Joule's heat when electric current is caused to pass therethough.

24. The sublimation type thermosensitive image transfer recording medium as claimed in claim 23, wherein said material comprises an electroconductive material dispersed in an insulating material.

25. A thermosensitive image transfer recording process comprising the steps of:

superimposing the sublimation type thermosensitive image transfer recording medium as claimed in claim 1 on a receiving sheet; and applying heat imagewise to said sublimation type thermosensitive image transfer recording medium so as to imagewise transfer said sublimable dye from said recording medium to said receiving sheet by a heat application recording means as said recording medium and said receiving sheet are moved at an equal speed.

26. A thermosensitive image transfer recording process comprising the steps of:

superimposing the sublimation type thermosensitive image transfer recording medium as claimed in claim 1 on a receiving sheet; and applying heat imagewise to said sublimation type thermosensitive image transfer recording medium so as to imagewise transfer said sublimable dye from said recording medium to said receiving sheet by a heat application recording means as said recording medium and said receiving sheet are moved in such a manner that the running speed of said recording medium is smaller than that of said receiving sheet.

* * * * *